US007761967B2

(12) United States Patent
McCracken

(10) Patent No.: US 7,761,967 B2
(45) Date of Patent: Jul. 27, 2010

(54) METHOD OF ASSEMBLING A SHORE POST LEG ASSEMBLY

(75) Inventor: Robert McCracken, Urbandale, IA (US)

(73) Assignee: Wilian Holding Company, Des Moines, IA (US)

( * ) Notice: Subject to any disclaimer, the term of this patent is extended or adjusted under 35 U.S.C. 154(b) by 1112 days.

(21) Appl. No.: 11/432,076

(22) Filed: May 11, 2006

(65) Prior Publication Data

US 2007/0262228 A1 Nov. 15, 2007

(51) Int. Cl.
*B23P 11/00* (2006.01)
*E04G 25/04* (2006.01)

(52) U.S. Cl. ..... 29/434; 29/515; 29/516; 29/517; 29/522.1; 248/354.1; 248/354.5

(58) Field of Classification Search ..... 29/434, 29/437, 515, 516, 517, 522.1, 523; 249/24; 403/277, 280, 281; 405/282; 248/354.1, 248/354.5
See application file for complete search history.

(56) References Cited

U.S. PATENT DOCUMENTS 1,349,576 A * 8/1920 Markham ..... 254/106
3,362,167 A * 1/1968 Ward ..... 405/282
3,870,268 A * 3/1975 Larkin ..... 248/354.1
4,793,646 A 12/1988 Michaud
5,085,398 A * 2/1992 Holcomb et al. ..... 249/24
5,273,415 A * 12/1993 Jackson ..... 425/62
5,310,153 A * 5/1994 Jackson ..... 248/354.5
5,772,169 A * 6/1998 Blockley ..... 248/333
5,979,854 A * 11/1999 Lundgren et al. ..... 248/354.3

* cited by examiner

*Primary Examiner*—Jermie E Cozart
(74) *Attorney, Agent, or Firm*—Kent A. Herink; Emily E. Harris

(57) ABSTRACT

A method of assembling a metal shore post of a concrete forming assembly is disclosed. An outer telescoping tube is provided that has a main section with a first inside diameter and top portion with a section having a second inside diameter reduced relative to the first inside diameter of the outer tube. An inner telescoping tube is inserted for telescopic movement inside the outer tube. After assembly, a pair of pistons are inserted through access holes in the outer tube to provide a crushing force to the inner tube deforming it to create a region of increased diameter that is greater than that of the reduced diameter section but not so large as to prevent telescopic movement of the inner tube inside the outer tube. The increased dimension region thereby prevents accidental separation of the inner tube from the assembly, thereby improving safety and efficiency. Openings are provided in the inner tube in the region being crushed in order to control the region of deformation.

10 Claims, 2 Drawing Sheets

METHOD OF ASSEMBLING A SHORE POST LEG ASSEMBLY

BACKGROUND OF THE INVENTION

The invention relates generally to concrete form apparatus and, more specifically, to an assembly of leg members of a shore post component of concrete form systems that does not require welding of the leg members in forming the assembly.

Concrete forming apparatus is in wide use in the construction of buildings, bridges, and other concrete structures. A common system for forming concrete structures uses a plurality of modular form components that are adapted to be assembled into a wide variety of configurations to conform to virtually any architectural requirement. Such forming apparatus components are typically made of metal so that they are strong enough to support the heavy weight of poured concrete and durable so that the components can be reused many times.

A common application of concrete forming apparatus is in the formation of elevated sections, such as floors or horizontal beams of a concrete building. Typically, pluralities of modular form panels are assembled to form the surface on which the concrete will be poured. These panels are supported on metal shore posts that typically are constructed of an inner tube that is received for telescopic movement inside an outer tube. Metal tubes achieve high load capacity and the telescoping tubes provide adjustment to various heights. For corrosion resistance, the tubes may be galvanized.

For convenience and safety, it is desirable to secure the two telescopic tubes to each other so that they do not accidentally fall apart during handling between pours. A known method of securing the two tubes together is to provide the outer tube with a collar of reduced inner diameter. One end of the inner tube is deformed so that it will still slide inside the outer tube but cannot pass through the collar. The non-deformed end of the inner tube is inserted into the end of the outer tube opposite from the collar. An end plate is then attached to the end of the outer tube opposite the collar, thereby trapping the inner tube for telescopic movement inside the outer tube. The end plate is attached either by welding or the use of mechanical fasteners. Welding of galvanized parts, however, presents health concerns for the welders and also results in the formation of areas of the shore post that are not protected by galvanizing. Fasteners require additional materials, assembly time and labor.

The preferred embodiments of the present invention eliminate the need either for welding or the use of mechanical fasteners. The inner tube is deformed after both galvanizing of the parts and assembly of the inner tube inside the outer tube to which an end plate has already been attached.

SUMMARY OF THE INVENTION

The preferred embodiment of the present invention consists of a leg assembly of a shore post used in concrete forming apparatus that is assembled from galvanized tubes without the need for welding or mechanical fasteners. An outer tube is secured to a foot pad or the like, using either welding or mechanical fasteners and the assembled part is then galvanized. The outer tube includes an upper end section of reduced inner diameter. An inner tube is inserted into the outer tube through the upper end section for telescopic movement relative to the outer tube. A pair of holes on opposite sides of the outer telescoping tube allow access to the inner telescoping tube for pistons to partially crush and deform the lower end portion of the inner tube out of round so that it has a dimension that is greater than the inner diameter of the reduced diameter end section but still less than the inner diameter of the outer tube. The inner telescoping tube is thus trapped inside the outer tube and the two parts of the leg assembly cannot accidentally fall apart during use. In the preferred embodiment, holes are cut in the inner tube at the region to be crushed in order to control the deformation. If it is desired to disassemble the tubes, the pistons can be used to compress the deformed region of the inner tube back toward a round profile so that the deformed region can again pass the reduced diameter section of the outer tube.

An object of the present invention is to provide a leg assembly for shore posts of concrete forming apparatus that does not require welding or the use of mechanical fasteners after the parts have been galvanized.

Another object of the present invention is to provide a leg assembly for shore posts of concrete forming apparatus that prevents accidental separation of the leg assembly during use but can be easily disassemble if required for repair, replacement of parts, or the like.

These and other objects will be understood by those skilled in the art upon a review of this specification, the associated figures and the appended claims.

DETAILED DESCRIPTION OF PREFERRED EMBODIMENTS

Figure 1:
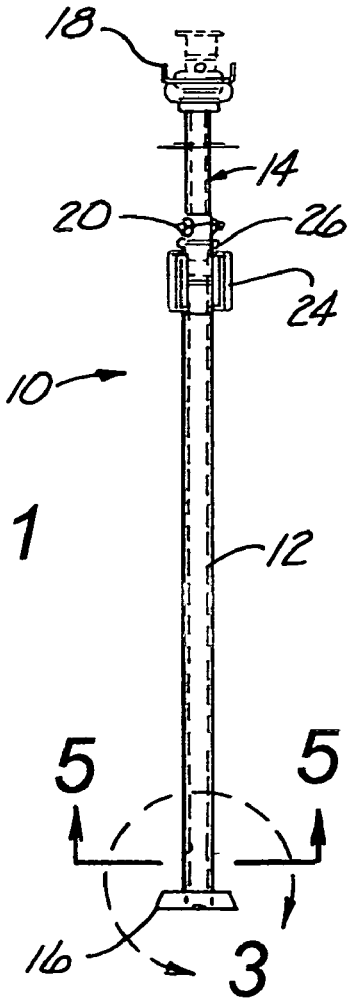
FIG. 1 is an elevational view of a shore post representing a preferred embodiment of the present invention in a foreshortened or collapsed position.
Figure 2:
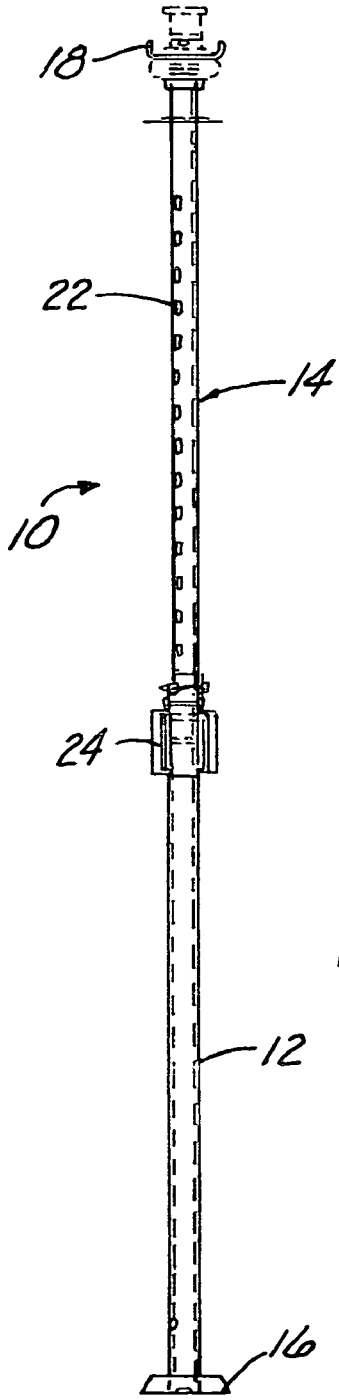
FIG. 2 is an elevational view of a shore post representing a preferred embodiment of the present invention in a lengthened or expanded position.

Illustrated in FIGS. 1 and 2, generally at 10, is a shore post representing a preferred embodiment of the present invention. The shore post 10 includes an outer telescoping tube 12, an inner telescoping tube 14, a foot pad 16 and a drop head 18. The shore post 10 may be telescopically adjusted in length between a foreshortened or collapsed position (FIG. 1) and an lengthened or extended position (FIG. 2). The shore post 10 may be set at a plurality of adjusted lengths by use of a pin 20 that is inserted into a pair of diametrically opposed holes in the outer tube 12 and a selected pair of a plurality of holes 22 in the inner tube 14 spaced at a regular interval. Fine adjustment of the length of the shore post 10 is made by rotation of a threaded linkage member 24.

For reasons including economy and strength, the outer tube 12, inner tube 14 and foot pad 16 of the shore post 10 are typically made of steel. To protect the steel against corrosion, the parts may be treated, for example by hot-dip galvanizing. Galvanizing coats the steel parts with zinc which quickly oxidizes to form a protective coating on the steel. Unfortunately, welding of zinc galvanized parts releases zinc vapors that, if inhaled, are known to cause flu-like symptoms and so present a safety concern for workers. In addition, the corrosion protection may be compromised by the welding process.

While it is possible to use mechanical fasteners to secure the foot pad 16 to the outer tube 12, mechanical fasteners are expensive.

In a preferred embodiment of the present invention, the outer tube 12 is fitted with a threaded nut 26 (FIG. 1) which has a smaller inner diameter than the outer tube 12. The inner tube 12 is attached to the foot pad 16 by welding. After welding of the foot pad 16 to the outer tube 12, the assembled parts are treated by a process for preventing corrosion, such as hot-dip galvanizing.

Figure 4:
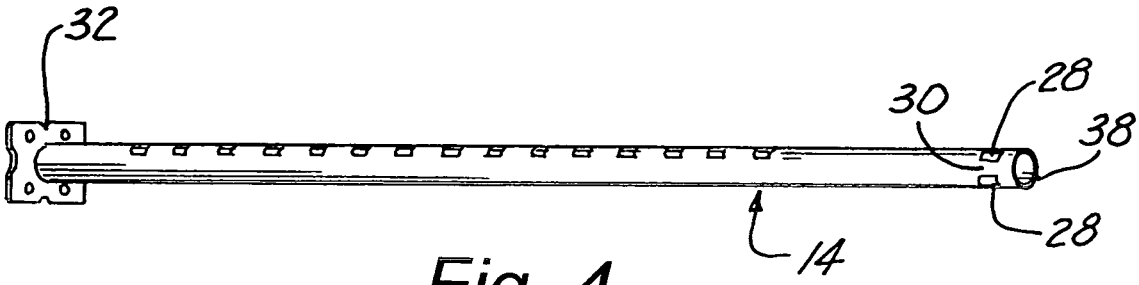
FIG. 4 is an enlarged view of the lower portion of the inner tube showing holes cut in the inner tube for controlling the deformation of the inner tube.

The inner tube 14 is formed with a plurality of spaced-apart holes 28 cut in the lower end portion, with each of the holes being separated by lands 30 (FIG. 4). In a preferred embodiment, there are four holes 28 and four lands 30. A top plate 32 is welded to the top end of the inner tube 14 for use in attaching other components to the inner tube 14, such as the drop head 18. After attachment of the top plate 32 to the inner tube 14, the part is treated for protection against corrosion, for example by hot-dip galvanizing.

Figure 3:
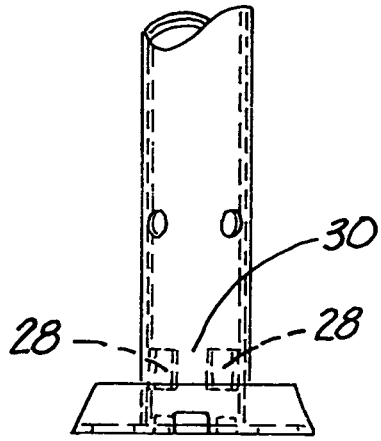
FIG. 3 is an enlarged view of the lower portion of the leg assembly showing the access holes in the outer tube for the pistons used in deforming the inner tube.
Figure 5:
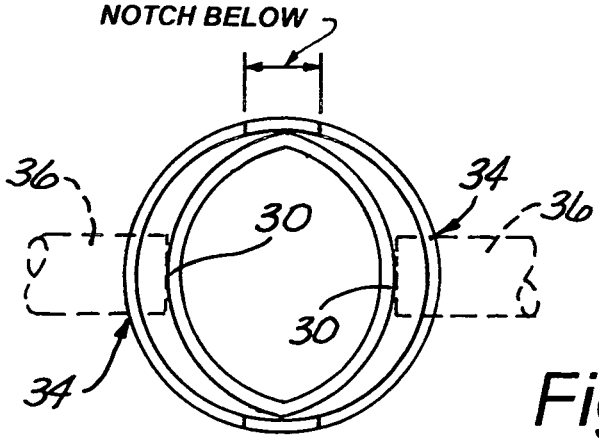
FIG. 5 is an enlarged, sectional view taken along the line 5-5 of FIG. 1 and showing in broken line the pistons used in deforming the inner tube.

To assemble the shore post 10, the lower end of the inner tube 14 is inserted into the top of the outer tube 12 through the nut 26. The inner tube 14 is thereby telescopically received in the outer tube 12 and is inserted until the region with the holes 28 and lands 30 is adjacent a pair of access holes 34 in the outer tube 12 near the bottom end of the inner tube 12 (FIG. 3). The tubes 12 and 14 are then pivoted relative to each other so that a pair of the lands 30 are aligned with the access holes 34 (FIG. 5). A pair of pistons 36 are inserted through the access holes 34 and brought into contact with the lands 30. Further movement of the pistons 36 toward each other will crush or deform the lower end portion of the inner tube 14 in the region of the holes 28 and lands 30. The holes 28 will act to restrain the area of deformation to the region closely adjacent to the holes 28. The pistons 36 crush the inner tube 14 until the deformed region, upon removal of the pistons 36, has an enlarged dimension that is greater than the reduced inner diameter of the nut 26 but is still less than the inner diameter of the outer tube 12. In practice, it has been found that the pistons 36 are moved inwardly to crush the inner tube 14 until the deformed section comes into contact with the outer tube 12. The metal of the inner tube 14 will rebound upon removal of the crushing force sufficient to permit telescopic movement of the inner tube 14 inside the outer tube 12. Accordingly, the inner tube 14 will still slide telescopically within the outer tube 12, but the enlarged dimension of the deformed region will prevent it from moving past the reduced diameter of the nut 26 and so the inner tube 14 will be prevented from accidentally falling apart from the shore post assembly 10.

If it becomes desirable to disassemble the shore post 10, for example for repair or replacement of parts, it is possible to use the pistons 36 to reduce the enlarged dimension of the inner tube 14 so that it will pass the nut 26. The inner tube 14 is positioned so that the enlarged dimension is aligned with the access holes 34 and the pistons 36 are used to crush the inner tube 14 to deform it until the enlarged diameter is less than the reduced inner diameter of the nut 26.

In a preferred embodiment, a pair of notches 38 (FIG. 4) are created in the inner tube 14 below the holes 28 and lands 30 and serve to constrain the deformation of the lower end of the inner tube 14 during the crushing operation.

While the foregoing description of the preferred embodiment has focused on the application of the present invention to shore posts of concrete forming apparatus, the invention also may be used to assemble other examples of telescoping tubes, such as wall form braces known in the industry as pipe braces.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

I claim:

1. A method of assembling a metal concrete forming assembly, comprising the steps of:

(a) providing an outer telescoping tube having a main section with a first inside diameter and an end portion with a section having a second inside diameter reduced relative to the first inside diameter of the outer tube, and the outer tube having an access hole perforating the outer tube;

(b) providing an inner telescoping tube having an end portion received for telescopic movement inside the outer tube and a deformation control opening perforating the inner tube; and (c) applying through the access hole in the outer tube a crushing force to the inner tube in the region of the deformation control openings to deform the inner tube to create a region having an enlarged dimension greater than the inside diameter of the reduced diameter section of the outer tube but less than the inside diameter of the outer tube to prevent the deformed region from moving past the reduced diameter section of the outer tube.

2. A method as defined in claim 1, wherein the outer tube is perforated by a pair of diametrically opposed access holes.

3. A method as defined in claim 2, wherein a pair of pistons are inserted through the pair of access holes and are moved toward each other in contact with the inner tube to apply the crushing force to the inner tube.

4. A method as defined in claim 1, wherein the inner tube is perforated by a pair of diametrically opposed openings separated by lands.

5. A method as defined in claim 4, wherein a pair of pistons are inserted through the pair of diametrically opposed openings and are moved toward each other in contact with the lands to apply the crushing force to the inner tube.

6. A method of assembling a metal shore post of a concrete forming assembly, comprising the steps of:

(a) providing an outer telescoping tube having a main section with a first inside diameter and top portion with a section having a second inside diameter reduced relative to the first inside diameter of the outer tube, and the outer tube having an access hole perforating the outer tube;

(b) providing an inner telescoping tube having an end portion received for telescopic movement inside the outer tube and a deformation control opening perforating the inner tube; and (c) applying through the access hole in the outer tube a crushing force to the inner tube in the region of the deformation control opening& to deform the inner tube to create a region having an enlarged dimension greater than the inside diameter of the reduced diameter section of the outer tube but less than the inside diameter of the outer tube to prevent the inner tube from accidentally falling out of the outer tube.

7. A method as defined in claim 6, wherein the outer tube is perforated by a pair of diametrically opposed access holes.

8. A method as defined in claim 7, wherein a pair of pistons are inserted through the pair of access holes and are moved toward each other in contact with the inner tube to apply the crushing force to the inner tube.

9. A method as defined in claim 6, wherein the inner tube is perforated by a pair of diametrically opposed openings separated by lands.

10. A method as defined in claim 9, wherein a pair of pistons are inserted through the pair of diametrically opposed openings and are moved toward each other in contact with the lands to apply the crushing force to the inner tube.

* * * * *